US010024276B2

(12) United States Patent
Winters

(10) Patent No.: US 10,024,276 B2
(45) Date of Patent: Jul. 17, 2018

(54) TRUCK AIR PRE-FILTER

(71) Applicant: Cab Fresh Filter Co., Glenwood, MO (US)

(72) Inventor: David J. Winters, Glenwood, MO (US)

(73) Assignee: Cab Fresh Filter Co, Glenwood, MO (US)

( * ) Notice: Subject to any disclaimer, the term of this patent is extended or adjusted under 35 U.S.C. 154(b) by 152 days.

(21) Appl. No.: 15/080,141

(22) Filed: Mar. 24, 2016

(65) Prior Publication Data

US 2016/0281657 A1 Sep. 29, 2016

Related U.S. Application Data

(60) Provisional application No. 62/137,945, filed on Mar. 25, 2015.

(51) Int. Cl.

| | |
|---|---|
| ***F02M 35/02*** | (2006.01) |
| ***F02M 35/16*** | (2006.01) |
| ***F02M 35/10*** | (2006.01) |
| ***F02M 35/024*** | (2006.01) |

(52) U.S. Cl.

CPC .... *F02M 35/0216* (2013.01); *F02M 35/0203* (2013.01); *F02M 35/02458* (2013.01); *F02M 35/10013* (2013.01); *F02M 35/164* (2013.01)

(58) Field of Classification Search

CPC ..... B01D 39/00; B01D 46/00; B01D 46/24; B01D 46/42; B64B 1/24; B64B 27/00; F02M 35/022; F02M 35/02; F02M 35/024

USPC ... 55/385.3, 490, 502, 306, 336, 351.1, 463, 55/521, 488, 489, DIG. 17, 378, 381, 377, 55/498; 60/39.092; 244/53 B

See application file for complete search history.

(56) References Cited

U.S. PATENT DOCUMENTS

| | | | | |
|---|---|---|---|---|
| 3,747,305 | A * | 7/1973 | O'Dell | B01D 46/0001 55/341.1 |
| 4,015,961 | A * | 4/1977 | Howard | B01D 46/02 285/189 |
| 4,265,647 | A | 5/1981 | Donachiue | |
| 5,785,724 | A * | 7/1998 | Johnson | B01D 29/27 55/341.1 |
| 6,610,117 | B2 * | 8/2003 | Gieseke | B01D 46/0001 123/198 E |
| 6,758,885 | B2 * | 7/2004 | Leffel | B01D 53/02 55/385.3 |
| 6,872,232 | B1 * | 3/2005 | Pavlatos | B01D 45/12 55/306 |
| 7,625,415 | B2 * | 12/2009 | Durocher | B01D 39/12 244/53 B |

(Continued)

FOREIGN PATENT DOCUMENTS

| | | |
|---|---|---|
| CN | 201650522 | 11/2010 |

*Primary Examiner* — Duane Smith
*Assistant Examiner* — Minh-Chau Pham
(74) *Attorney, Agent, or Firm* — McKee, Voorhees & Sease, PLC

(57) ABSTRACT

An air pre-filter assembly is provided for installation in the OEM air inlet of an internal combustion engine in a vehicle. The pre-filter assembly includes a polyester fiber filter retained in the inlet duct by a spring-clip or a ring. The pre-filter and ring reside completely within the air duct, and requires no additional structure. The pre-filter assembly is located upstream from the primary filter, and can be replaced or removed for cleaning, as needed.

19 Claims, 3 Drawing Sheets

(56) References Cited

U.S. PATENT DOCUMENTS

| | | | | |
|---|---|---|---|---|
| 7,854,780 | B2 * | 12/2010 | Hirsch | B01D 39/12 123/184.53 |
| 2004/0139708 | A1 * | 7/2004 | Giacinto | F02M 29/04 55/385.3 |
| 2011/0056383 | A1 * | 3/2011 | Make | B01D 46/0023 96/396 |
| 2014/0150384 | A1 * | 6/2014 | Bunnell | F02M 35/088 55/332 |
| 2016/0108866 | A1 * | 4/2016 | Dewit | B01D 46/0002 55/385.3 |

* cited by examiner

TRUCK AIR PRE-FILTER

BACKGROUND OF THE INVENTION

Motor vehicles having an internal combustion engine require air for combustion of the fuel. The air needs to be cleansed of dust and other particles prior to entering the combustion chamber. Therefore, air filters are commonly used in the air intake duct to remove impurities from the air. Sufficient airflow through the engine is critical for optimum engine performance. As the filter becomes dirty, airflow through the filter is reduced, which decreases engine efficiency and increases fuel consumption. Therefore, when the air filters become clogged or otherwise saturated by the air impurities, the filters must be cleaned or replaced. Cleaning the air filters rarely returns the filter to its new condition, since many foreign particles cannot be washed or blown from the filter material. Replacement of filters may become expensive. Replacement or cleansing of the filters also requires labor, which adds to the time and cost.

Pre-filters are known for combustion engines, such as disclosed in U.S. Pat. No. 4,265,647. However, such prior art pre-filter assemblies require structural components mounted to the original equipment manufacture (OEM) air supply in the engine compartment of the vehicle. Many vehicles do not have sufficient open space in the engine compartment to accommodate such additional structure. Also, the prior art pre-filter structures may require some of the OEM structure to be removed, and be replaced with the new OEM pre-filter assembly structure. These prior art structures are costly and require time for installation.

Therefore, a primary objective of the present invention is the provision of a simple pre-filter in the air intake duct to extend the life of the primary air filter.

Another objective of the present invention is the provision of a pre-filter which can be quickly and easily mounted inside the air inlet duct for the engine.

A further objective of the present invention is a provision of a polyester fiber pre-filter which can be installed in the OEM air duct of a combustion engine.

Still another objective of the present invention is the provision of a pre-filter and mounting ring which reside within the OEM air duct or combustion engine.

Yet another objective of the present invention is the provision of a pre-filter assembly which requires no additional space in the engine compartment of a vehicle, beyond the space of the OEM air supply channel.

Another objective of the present invention is the provision of a secondary filter upstream from a primary filter in the air supply channel for an internal combustion engine.

A further objective of the present invention is the provision of a pre-filter for an internal combustion engine which is economical to manufacture, and simple and safe to use.

These and other objectives will become apparent from the following Description of the Invention.

SUMMARY OF THE INVENTION

The pre-filter assembly of the present invention is installed in the original equipment manufacture air duct for an internal combustion engine. The assembly includes a filter element and a retention ring, both of which reside completely within the air duct, upstream from the primary air filter for the engine. The ring has an expandable diameter so as to accommodate different sized air ducts. The retention ring or member may be external to the pre-filter, or alternatively, may be enclosed within the pre-filter. The pre-filter can be quickly and easily installed, and removed for cleaning or replacements. The pre-filter captures allows air to pass through while capturing airborne particles for a preliminary filtering step before the air passes through the primary air filter for the engine, thus extending the life of the primary filter and minimizing cleaning and replacement of the primary filter.

DETAILED DESCRIPTION OF THE PREFERRED EMBODIMENTS

The air pre-filter 10 is mounted in the air inlet duct 12 of an internal combustion engine of a motor vehicle. The duct 12 is shown to be circular, though it is understood that the duct may have any shape, such as square or rectangular, with the pre-filter 10 have a shape corresponding to the shape of the duct 12.

Figure 1:
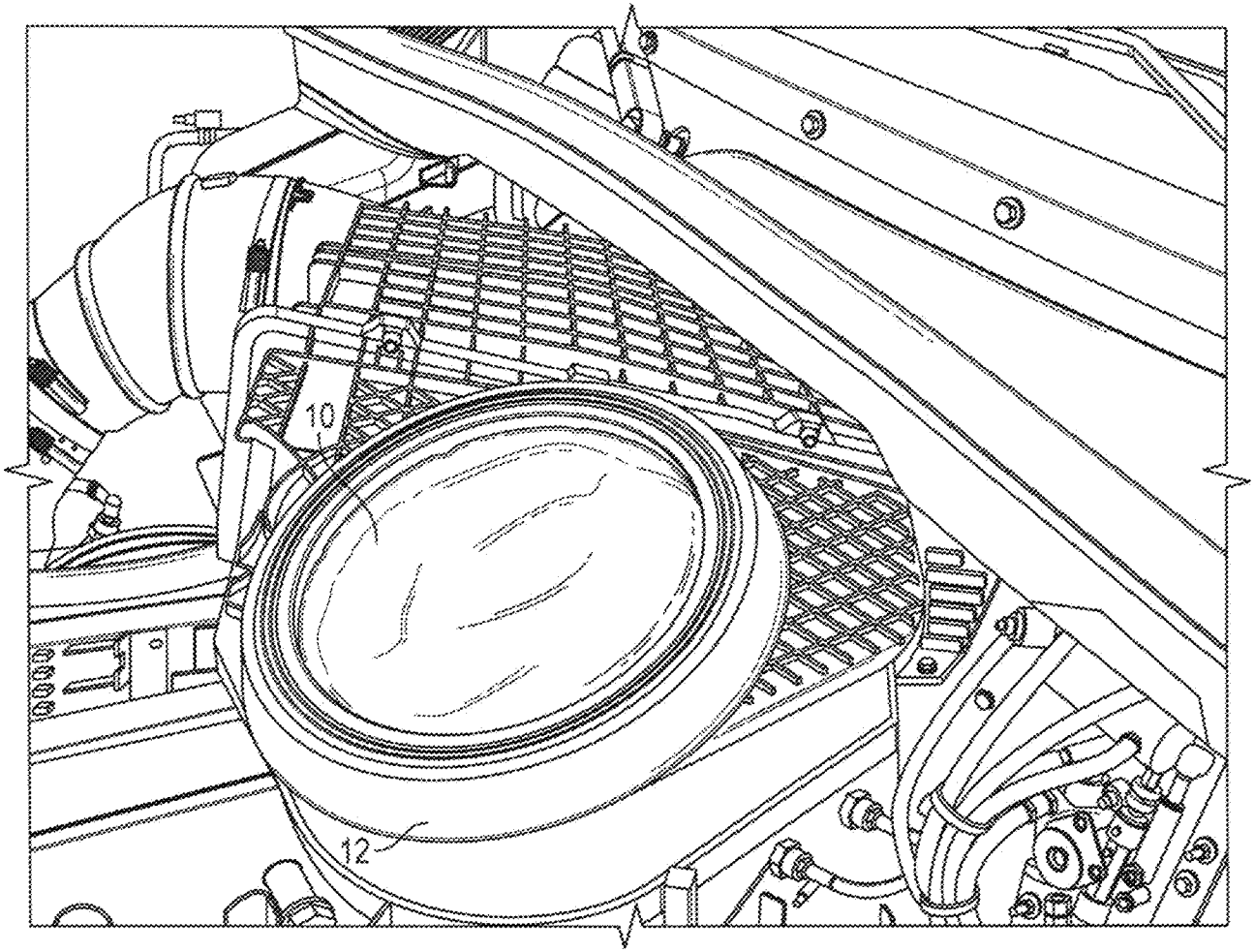
FIG. 1 shows the pre-filter of the present invention installed in the air inlet duct for an internal combustion engine of a motor vehicle.
Figure 2:
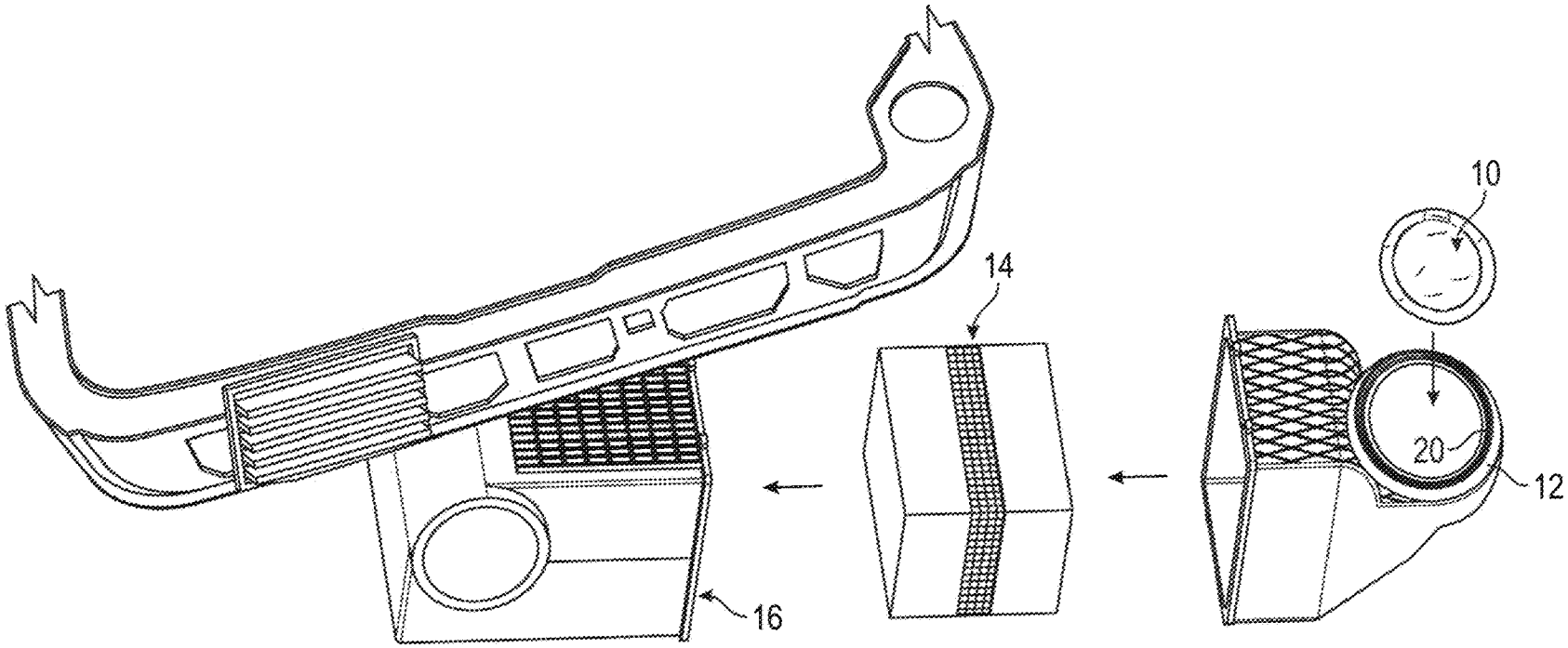
FIG. 2 is an exploded view of the air inlet duct and primary filter for an internal combustion engine of a motor vehicle

The air intake assembly of the motor vehicle is schematically shown in FIG. 2, and includes the OEM air inlet duct 12, and an OEM downstream filter box 14 having a primary filter removably mounted in the box 14. The filter box 14 is mounted to the OEM air intake housing or manifold 16. The inlet duct 12, the filter box 14, the primary filter, and the housing or manifold 16 are conventional and may come in various shapes and configurations beyond that shown in the photographs and drawings. The duct 12, box 14, and manifold 16 define a channel for supplying air to the combustion chamber of the engine.

The pre-filter 10 can be made of any filtering material, such as a polyester fiber. Preferably, the pre-filter 10 is made with a double layer polyester fiber fabric sewn together. The fiber material can be easily cleaned by washing or blowing air through the fabric to remove dust and other airborne contaminates captured by the pre-filter 10.

Figure 3:
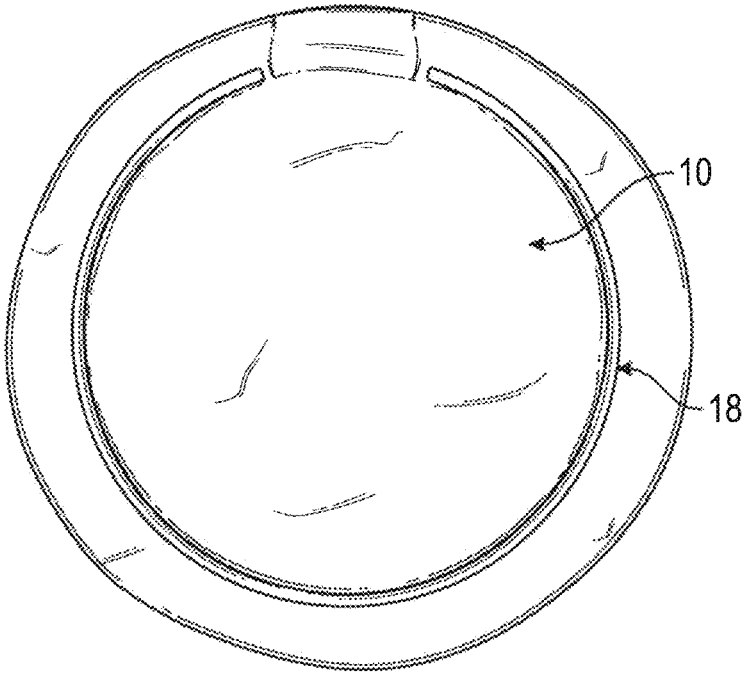
FIG. 3 shows the pre-filter and retaining ring used in air intake duct according to the present invention.
Figure 4:
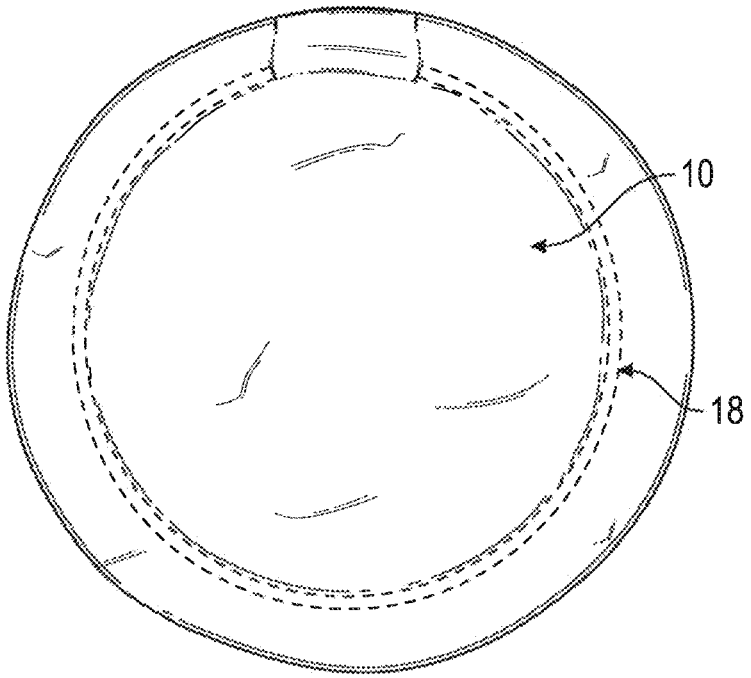
FIG. 4 shows a pre-filter with an internal retaining ring.

The pre-filter 10 is retained in the inlet duct 12 by a retaining ring 18. Preferably, the ring 18 is a resilient metal ring having a diameter smaller than the diameter of the pre-filter 10. The retaining ring 18 preferably has a cutout or opening so that the ring does not extend a full 360°, but rather can be compressed to a smaller diameter to fit into the air duct 12 and then expanded to a larger diameter, similar to a snap ring, for retention in the air duct 12. The ring 12 may be separate from the pre-filter 10, as shown in FIG. 3, or may be encased within the pre-filter 10, as seen in FIG. 4.

In use, the pre-filter 10 can be quickly and easily installed in the air duct 12 upstream from the filter box 14 and primary filter. The pre-filter 10 is manually pushed through the opening of the duct 12, and then the external retaining ring 18 is manually fit beneath the upper radially lip 20 of the duct 12 and then released so as to reside beneath the lip 20 and thereby retain the pre-filter 10 in position inside the air duct 12. For a pre-filter 10 with the internal retaining ring 18, the ring is compressed before the pre-filter is inserted into the duct 12, and the ring is then released to expand into retentive engagement with the wall of the duct. When the pre-filter 10 needs cleaning or replacement, the retaining ring 18 can be grasped by a user's fingers or with a pair of plyers and easily removed from the duct 12, and then the pre-filter 10 pulled from the duct 12.

The pre-filter removes a substantial portion of airborne particles in the air prior to such particles reaching the primary filter. The primary filter then captures finer particles which pass through the pre-filter. Thus, the life of the primary filter is extended substantially while substantial quantities of clean air are provided to the combustion chamber of the engine. Thus, the pre-filter enhances the engine performance and minimizes costs of replacement or cleaning of the primary filter.

What is claimed is:

1. An air pre-filter assembly for a vehicle having an engine, an OEM air inlet channel for supplying air to a combustion chamber for the engine, with a primary filter in the channel, the assembly comprising:

a pre-filter positioned inside the OEM air inlet channel upstream from the primary filter; and a resilient, compressible metal ring to retain the pre-filter in the OEM air inlet duct having a cutout preventing the resilient, compressible metal ring from extending a full 360°.

2. The pre-filter assembly of claim 1 wherein the pre-filter removes larger airborne particles and the primary filter removes smaller airborne particles.

3. The pre-filter assembly of claim 1 wherein the pre-filter has a diameter substantially equal to a diameter of the air inlet duct.

4. The pre-filter assembly of claim 1 wherein the pre-filter is made of polyester fiber.

5. The pre-filter assembly of claim 4 wherein the pre-filter is a double layer of the polyester fiber.

6. The pre-filter assembly of claim 1 wherein the metal ring is internally positioned within the pre-filter.

7. An air filter system for a vehicle having a combustion engine with an air intake manifold, the system comprising:

an air duct;

a filter box between the inlet duct and the intake manifold;

a primary air filter in the filter box; and a secondary air filter in the air duct upstream from the primary filter, said secondary air filter having a ring with an opening to allow for compression and expansion of the secondary air filter.

8. The air filter system of claim 7 wherein the secondary filter is removably mounted in the air duct.

9. The air filter system of claim 7 further comprising a metal expansion ring to retain the secondary filter in the air duct.

10. The air filter system of claim 9 wherein the ring is enclosed within the secondary filter.

11. The air filter system of claim 7 wherein the secondary filter is manually installed in the air duct without tools.

12. The air filter system of claim 7 wherein the air duct and the secondary filter have substantially matching cross sections.

13. The air filter system of claim 7 wherein the secondary filter is a polyester fabric.

14. The air filter system of claim 13 wherein the secondary filter has two layers of the polyester fabric.

15. The air filter system of claim 13 wherein the polyester fabric is a fibrous material.

16. A method of filtering air for a vehicle engine, comprising: pg,9 positioning a primary air filter in an OEM air inlet channel of the engine;

positioning an air pre-filter in the OEM air inlet channel ahead of the primary filter;

retaining the pre-filter inside the air inlet channel with a metal snap ring having a cutout such that the snap ring revolves less than one revolution and is reliantly compressible; and wherein the pre-filter filters the air a first time and the primary filter filters the air a second time.

17. The method of claim 16 further comprising retaining the pre-filter inside the air inlet channel with a snap ring.

18. The method of claim 16 wherein the pre-filter is removably mounted in the air inlet channel.

19. The method of claim 16 further comprising removing the pre-filter from the air duct, cleaning the pre-filter, then re-installing the cleaned pre-filter in the air duct, all without removing the primary filter.

* * * * *